United States Patent [19]

Kokubo et al.

[11] 4,436,102

[45] Mar. 13, 1984

[54] COIN DISCHARGE MACHINE AND PARTITIONED CARTON

[75] Inventors: Eiichi Kokubo; Kyoichi Osako, both of Toyko, Japan

[73] Assignee: Laurel Bank Machine Co., Ltd., Tokyo, Japan

[21] Appl. No.: 267,885

[22] Filed: May 28, 1981

[30] Foreign Application Priority Data

May 30, 1980 [JP] Japan ..... 55/74948[U]

[51] Int. Cl.[3] ..... G07D 1/08

[52] U.S. Cl. ..... 133/2; 133/1 R

[58] Field of Search ..... 133/1 R, 4 R, 4 A, 5 R, 133/3 R, 3 A–3 H, 8 A, 8 R, 2; 206/0.84

[56] References Cited

U.S. PATENT DOCUMENTS

| | | | |
|---|---|---|---|
| 512,959 | 1/1894 | Hanvey | 133/3 D |
| 802,550 | 10/1905 | Batdorf et al. | 133/1 R |
| 1,120,081 | 12/1914 | Potter | 206/0.84 |
| 1,242,016 | 10/1917 | Mendelsohn | 133/4 A |
| 2,215,858 | 9/1940 | Slootsky | 206/0.84 |
| 2,646,055 | 7/1953 | Neilsen | 133/8 R |
| 4,326,550 | 4/1982 | Mochizuki et al. | 133/2 |

*Primary Examiner*—Stanley H. Tollberg

*Attorney, Agent, or Firm*—Fleit, Jacobson, Cohn & Price

[57] ABSTRACT

A coin discharge machine wherein a plurality of discharge passages separated from each other by a partition or partitions and communicated with dropping outlets corresponding to cartridges are provided, and more preferably, a carton having a plurality of receiving chambers at least partially separated from each other by partition or partitions is further provided. The chambers are disposed under and correspondingly to the respective discharge passages.

8 Claims, 4 Drawing Figures

COIN DISCHARGE MACHINE AND PARTITIONED CARTON

BACKGROUND OF THE INVENTION

This invention relates to a coin discharge machine. There have been known coin discharge machines wherein a plurality of cartridges, each accommodating coins of a given denomination are provided and coins accumulated in at least one selected cartridge are pushed out, one at a time, from the lowermost by a selected rod pusher into a coin dropping outlet while each of the coins being pushed is caused to be engaged with a counting arm which actuates a microswitch for counting. Each rod pusher is normally moved toward and away from the coin dropping outlet below the coins accumulated in the cartridge during non-operation. During operation, at least one selected rod pusher is brought up to an operating position or an upper position by a biasing means and pushes the lowermost coin out of the cartridge into the coin dropping outlet.

There have been known prior art machines such as that described in U.S. Pat. No. 4,226,253 issued on Oct. 7, 1980 to Kokubo et al., who are also the inventors of this invention. The above mentioned U.S. patent discloses a coin discharge machine for individually discharging the lowermost coin from coins stacked in a cartridge and for transferring the discharged coin to a dropping outlet, said machine comprising:

support means for supporting coins stacked in a cartridge in such manner that the lowermost coin has a portion thereof supported and spaced apart, longitudinally-extending non-supported portions;

a pair of longitudinally-extending rod pushers mounted for continuous reciprocating movement below the cartridge, each of said pushers being formed at an end thereof with an upwardly extending projection, the pushers being mounted in such manner to be movable between raised positions with the projections contacting edges of the non-supported portions of the lowermost coin and lowered positions with the projections lower than the lowermost coin;

means for axially reciprocating said pushers between the cartridge and a dropping outlet;

means for moving said pushers into said raised positions during forward strokes thereof so that said raised projections contact edges of the lowermost coin and transfer the coin to the dropping outlet, and for moving said pushers into said lowered positions during rearward strokes thereof so that said lowered projections pass beneath residual stacked coins, the residual coins being supported by said support means after removal of the lowermost coin; and counting means for counting transferred coins and including a count arm positioned between the cartridge and the dropping outlet, said count arm being disposed to be engaged by a center portion of a coin being transferred.

In a preferred embodiment of the above coin discharge machine, said support means comprises a support plate having grooves formed therein for passage of said rod pushers. In the above machine or in combination with the machine, a carton is disposed in a coin receiving section, into which a coin pushed out of the cartridge and then introduced into the coin dropping outlet falls down a discharge passage.

One of disadvantages of the conventional carton and discharge passage is that the carton is formed with only one receiving chamber therein. That is, the carton has no partition therein, so that different denominations of coins pushed out of the cartridges are allowed to be intermingled with each other in the chamber. In order to count the coins of each denomination thus pushed out to calculate the total amount of the coins, therefore, it is necessary for the coins to be sorted into their respective denominations. Such sorting operation is troublesome and inefficient.

More particularly, in bank management, coins of various denominations pushed out of the cartridges must be sorted into their respective denominations for counting, and the coins are handed over to the customers after confirmation of the denominations and the total value. Thus, customers have to wait for a long time while the sorting and calculating operations are carried out.

SUMMARY OF THE INVENTION

It is, therefore, an object of the invention to provide a coin discharge machine which eliminates the above-mentioned disadvantage.

It is a further object of the invention to provide a coin discharge machine which permits coins of various denominations to be automatically sorted by their denominations to thus eliminate the manual sorting operation.

According to the invention, there is provided a coin discharge machine which comprises:

a plurality of cartridges each accommodating coins of a given denomination;

a coin discharge mechanism for individually discharging the lowermost coin from coins stacked in said cartridges and for transferring the discharged coin to a dropping outlet; and a plurality of discharge passages separated from each other by partitions and communicated with said dropping outlets corresponding to said cartridges.

DESCRIPTION OF THE DRAWINGS

The invention will be now explained with reference to the accompanying drawings in which.

DETAILED DESCRIPTION OF THE PREFERRED EMBODIMENTS OF THE INVENTION

Figure 1:
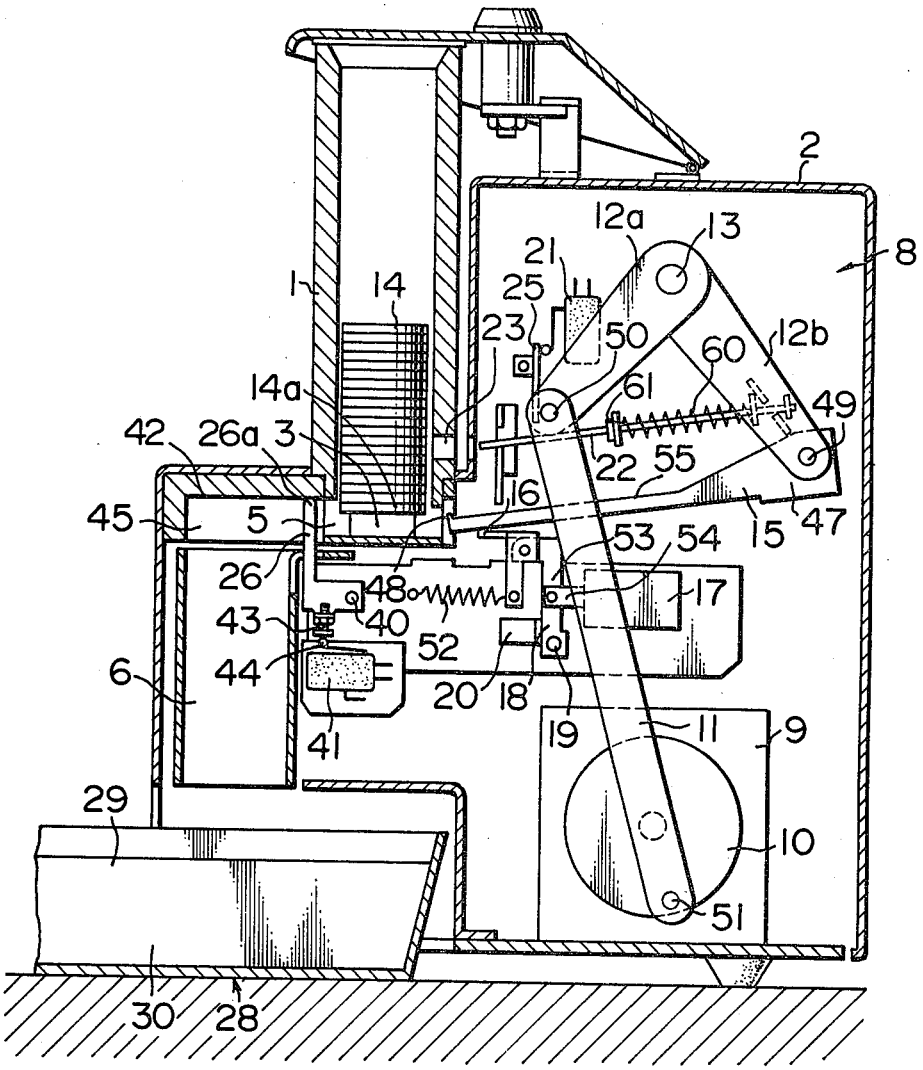
FIG. 1 is a side sectional view showing the internal construction of a coin discharge machine according to the present invention.
Figure 2:
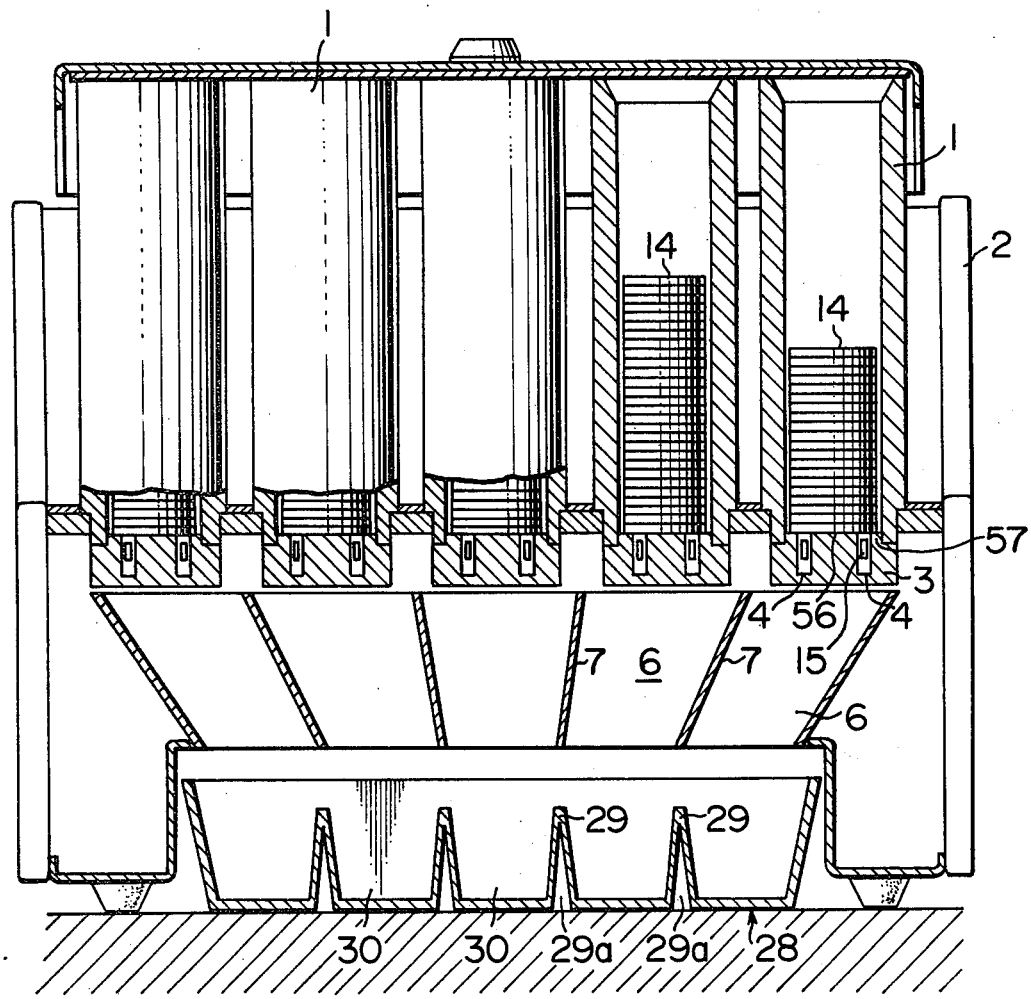
FIG. 2 is a partially sectioned front view of the machine in FIG. 1.

Referring now to FIG. 1 and FIG. 2, a coin discharge machine is provided with a plurality of, for example five, cartridges 1 for accommodating coins of various denominations with each cartridge accommodating coins of only one given denomination different from the others. The cartridges are removably mounted on a case 2 at the front top portion thereof. For clarity of illustration, in FIG. 1, only one of the cartridges and members associated therewith will be explained. The cartridge 1 of a hollow cylindrical form is joined at the bottom end thereof to a circular support plate 3 and is supported on the frame of the machine as shown in FIGS. 1 and 2. The support plate 3 is formed with a reduced circular extension 57 upwardly coaxially of the support plate body 3 as shown in FIG. 2. The support plate 3 is also formed with two parallel grooves 4 which extend one along each sides thereof toward a coin dropping outlet 45 between the lower surface 42 of the frame and an edge 26*a* of a count arm 26 (FIG. 1). Each of the grooves 4 is adapted to be passed through by a rod pusher 15 as will be explained hereinafter in more detail. In front of the grooves 4 (lefthand side in FIG. 1) a discharge port 5 is provided. The number of the discharge ports 5 is equal to the number of the cartridges 1. Coins to be pushed are accumulated or stacked in the cartridge 1 and the lowermost coin is supported on the upper surface 56 of the extension 57. The lowermost coin 14*a* is pushed out by a pair of rod pushers 15, which will be explained hereinafter in more detail, toward the coin dropping outlet 45 between the lower surface of the frame 42 and the edge 26*a* of the count arm 26 from the cartridge. The coin thus pushed and then introduced into the coin dropping outlet 45 falls down a vertical discharge cylinder i.e. a discharge passage 6 into a carton 28 disposed in a coin receiving section.

Referring to FIG. 2, a plurality of discharge passages 6, in this case five passages, are disposed under the coin dropping outlets 45 communicated with the discharge ports 5 (FIG. 1). The discharge passages 6 are separated from each other by partitions 7 and communicated with the dropping outlets of the cartridges 1.

Figure 3:
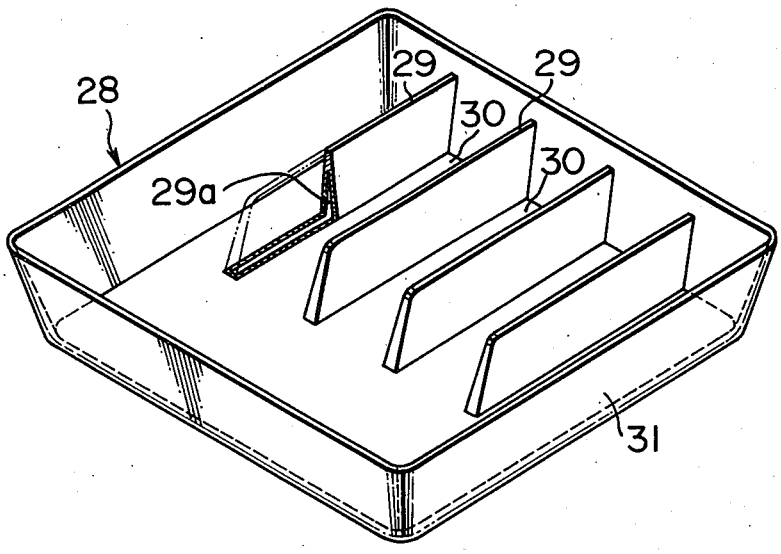
FIG. 3 is a perspective view of a carton used in the machine in FIG. 1.
Figure 4:
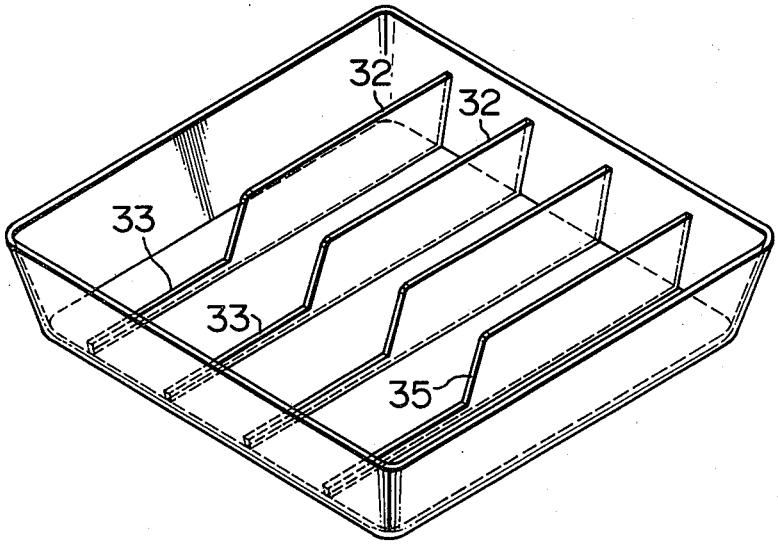
FIG. 4 is a perspective view of another embodiment of a carton used in the machine in FIG. 1.

In FIG. 2, a carton is generally designated by 28. The carton 28 includes a plurality of receiving chambers 30. The chambers 30 are separated at least partially from each other by partitions 29, 32, 33 (FIG. 3 and FIG. 4). The chambers 30 are disposed under the discharge passages 6.

In FIG. 3, the partitions 29 of the carton 28 extend only along a part of the length of the carton and this part of the length generally corresponds to the discharge passages 6.

In FIG. 4, the partitions 32, 32 extend over the entire length of the carton 28 and are formed so as to have two different heights. The higher partitions are laid generally correspondingly to the discharge passages 6. The lower partitions 33 are laid in a more forward position than the partitions 32.

Referring to FIG. 2, a cross section of each of the partitions 29 of the carton 28 is of a reverse-V-shaped configuration and the periphery of side walls 31 (FIG. 3) of the carton 28 are downwardly inwardly inclined. Therefore, when two cartons are stacked, the top portions 29 of the partitions of the lower carton may be brought up at least partially into reverse-V-shaped recesses 29*a* defined at undersides of the partitions of the upper carton. Consequently, a plurality of the thus stacked cartons 28 will take up only a relatively small space.

The cartons shown in FIG. 3 and FIG. 4 can prevent the coins of various denominations from intermingling with each other before the numbers of the coins are confirmed, and yet can facilitate the taking-up of the coins after confirmation. Furthermore, the carton shown in FIG. 4 has the lower partitions 33 which prevent the coins from intermingling even after the coins have been confirmed and yet can facilitate the taking-up of the coins.

In the carton as shown in FIG. 4, there are provided transition portions 35 between the higher partitions 32 and the lower partitions 33. The transition portions 35 are gradually varied in height from the partitions 32 to the partitions 33. The transition portions 35 may be formed in straight form or in curved form.

Referring again to FIG. 1, a coin discharge mechanism is generally designated by 8. The mechanism 8 individually discharges the lowermost coin from coins 14 stacked in the cartridges 1 and transfers the discharged coin to the dropping outlet 45. The count arm 26 of L-shaped form is disposed just behind the cartridge 1 and is pivotably mounted at 40. The count arm 26 is supported on a micro-switch 41 mounted on the frame of the machine and the edge 26*a* of the count arm 26 is made to engage with the lower surface 42 through adjustment of a bolt 43 riding on an actuator 44 of the microswitch 41 which serves to close contacts, only one of which is shown in FIG. 1. The edge of the count arm 26 is disposed so that the coin being pushed by the pair of rod pushers 15 is forced to ride on the edge of the count arm at the longitudinally center line or diametrical line of the coin. Therefore, when the lowermost coin 14*a* is pushed and forced to ride on the edge of the count arm and thereby to pass between the lower surface 42 of the frame and the edge 26*a* of the count arm 26, the count arm is rotated in an anti-clockwise direction about the pivot 40 and thus the bolt 43 depresses the actuator 44 of the microswitch 41 to close the contacts, giving a count. The pair of rod pushers 15 are disposed adjacent the support plate 46 and are integrally formed with the base 47 of the rod Pushers so that the two rod pushers are parallel to each other. Each rod pusher is provided at the end thereof with a triangle projection 48 on the upper surface 55 of the rod pusher 15. The base 47 is pivotably mounted on one end of a bell crank (12*a*, 12*b*) at a pivot pin 49. The bell crank is pivotably mounted on the frame of the machine at a pivot 13 and the other end thereof is pivotably mounted at a pivot pin 50 on an interconnecting rod 11 at one end thereof, which is in turn pivotably mounted at the other end thereof on a pin 51 mounted on the peripheral portion of a rotary member 10 of a motor 9. The rod pusher is thus moved through the groove 4 (FIG. 2) toward and away from the coin dropping outlet 45 when the motor 9 is actuated to cause the rotary member 10 to be rotated. In this instance, in non-operation condition or when a solenoid 17 is not actuated, which state will later be explained in more detail, although the rod pusher 15 is moved toward and away from the coin dropping outlet 45, the projection 48 of the rod pusher 15 passes below the lowermost coin 14*a* and does not engage with the same.

A select arm 16 is disposed under the pair of rod pushers 15 in engagement therewith and is biased by a tension spring 52 in an anti-clockwise direction. The select arm 16 is rigidly connected to a select bar 53 which is pivotably mounted at a pivot 19 and is connected to an actuator 54 of the solenoid 17. The select bar 53 is urged against a stopper 20 by the spring 52. When at least one solenoid 17 is selectively actuated, the actuator 54 of the selected solenoid 17 causes the select bar 53 and, therefore, the select arm 16 to rotate in a clockwise direction against the action of the tension spring 52 and thereby to bring the pair of rod pushers 15 to an upper position or an operation position. In operation position, the projections 48 of the rod pushers 15 are engaged with the lowermost coin 14*a* at the side portions of the periphery thereof while the upper surfaces 55 of the rod pushers 15 are flush with or below the surface 56 of the extension 57. Therefore, the stacked coins 14 put no load on the upper surfaces 55 of the rod pushers 15 since the lowermost coin is not supported on the upper surfaces 55 of the rod pushers but on the surface 56 of the extension 57.

In the forward stroke of the rod pushers, the selected rod pushers are brought up to the upper position or to the operation position by energizing the selected solenoid 17 and, therefore, are caused to be engaged with the lowermost coin 14*a* in the cartridge 1. The lowermost coin 14*a* is then pushed out of the cartridge 1 into the coin dropping outlet 45. In this instance, the rod pushers can push the coin beyond the edge 26*a* of the count arm 26 and can positively introduce the coin into the coin dropping outlet 45 in which the coin thus introduced drops down the discharge passage 6 into the carton 28 since the edge 26*a* of the count arm 26 does not interfere with the action of the rod pushers 15.

A detecting rod 22 is slidably connected to a oscillating lever 12*b* of the bell crank at one end thereof. The other end of the rod 22 is arranged opposite to an aperture 23 of the cartridge 1 so that the rod 22 can pass through the aperture 23 during the forward stroke thereof. During the forward stroke of the rod 22, if the left end (FIG. 1) of the rod 22 strikes the periphery of the stacked coins 14, the rod 22 is prevented from further movement. Therefore, a compression spring 60 will be compressed by the oscillating lever 12*b*. If the left end of the rod 22 does not strike the periphery of the stacked coins 14, that is, when the number of the stacked coins 14 is less than a predetermined number, the left end of the rod 22 can further proceed above the remaining coins in the cartridge 1. In this case, a projection 61 fixed on the rod 22 actuates a micro-switch 21 via a lever 25, whereby the decreased number of the stacked coins 14 is detected.

In operation, as shown in FIG. 2, a number of coins 14 are introduced into the cartridges 1. The lowermost coins 14*a* are supported on the surfaces 56 of the extensions 57 of the support plates 3 and, therefore, the weight of the coins is borne by the surfaces 56. As shown in FIG. 1, while the pairs of rod pushers 15 are moved from the position shown in FIG. 1 in which the pairs of the rod pushers 15 are spaced away from the support plates toward the grooves 4 of the support plates, one or more of the solenoids 17 are selectively actuated. In the forward stroke of rod pushers 15, the select arm 16 thus selected brings the pairs of rod pushers up to an operation position. The rod pushers enter into the grooves 4 and only the selected one or more pairs of rod pushers become engaged with the lowermost coins 14*a* at the side portions thereof by the projections 48 and push the lowermost coins 14*a* out of the cartridge while the nonselected rod pushers are not engaged with the coins. Each coin thus pushed is forced to ride on the edge 26*a* of the count arm 26 and then passes between the lower surface 42 and the edge 26*a*. Consequently, the count arm 26 is rotated to actuate the actuator 44 of the microswitch 41 to give a count. The coin is then further pushed beyond the edge 26*a* of the count arm 26 into the coin dropping outlet 45. Thus, the coin introduced into the coin dropping outlet 45 drops down the discharge passage 6 into the carton 28 disposed within the coin receiving sections.

After the rod pushers finish pushing the coin, the selected rod pushers are lowered into a non-operation position by de-energizing the solenoid 17 and are withdrawn in the backward stroke thereof. Then, the rod pushers are ready for the next cycle.

In this instance, when the rod pushers 15 push the lowermost coin out of the cartridge 1, the coin next to the lowermost coin drops onto the surface 56 of the extension 57. Therefore, the weight of the coins in the cartridge puts no load on the rod pushers and does not cause the rod pushers to be lowered. Therefore, the rod pushers can continue to push the lowermost coin until the lowermost coin is fully introduced into the coin dropping outlet.

From the foregoing description, it will be well appreciated that the coins of different denominations pushed out of the cartridges do not intermingle with each other before being calculated.

What is claimed is:

1. A coin discharge machine which comprises: a plurality of cartridges, each accommodating coins of a given denomination; a plurality of dropping outlets communicating with respective ones of said cartridges; a coin discharge mechanism for individually discharging the lowermost coin from the coins stacked in each said cartridge and for transferring the discharged coin to one of said dropping outlets; a plurality of discharge passages separated from each other by partitions and in communication with said dropping outlets corresponding to said cartridges; and a carton including a plurality of receiving sections separated from each other by partitions, said receiving sections being disposed under respective ones of said discharge passages, and an open collecting section connected to all said receiving sections for collecting coins from said receiving sections, whereby all received coins are collected in the collecting section and are easily picked up.

2. A coin discharge machine according to claim 1, wherein each said partition of said carton extends only along a part of the length of said carton, said length generally corresponding to said discharge passage.

3. A coin discharge machine according to claim 1, wherein each said partition of said carton extends over the entire length of said carton and is formed so as to have two different heights along said length, the portion of greater height being laid generally correspondingly to said discharge passages and the portion of smaller height being laid in a more forward position.

4. A coin discharge machine according to claim 1, wherein the cross section of each said partition of said carton is of a reverse-V-shaped configuration, and wherein the side walls of the carton are downwardly inwardly inclined, so that, when two cartons are stacked, the top portions of the partitions of the lower carton enter into the reverse-V-shaped recesses defined by undersides of the partitions of the upper carton.

5. A coin discharge machine according to claim 2 or 1 which further comprises means for detecting that the number of the stacked coins is less than a predetermined number.

6. A coin discharge machine according to claim 3, wherein there are provided transition portions between said portion of greater height and said portion of smaller height, said transition portions being gradually varied in height from said portion of greater height to said portion of smaller height.

7. A coin discharge machine according to claim 6, wherein said transition portions are formed in straight form.

8. A coin discharge machine according to claim 6, wherein said transition portions are formed in curved form.

* * * * *